US005335738A

United States Patent [19]

Waldenström et al.

[11] Patent Number: 5,335,738

[45] Date of Patent: * Aug. 9, 1994

[54] TOOLS FOR PERCUSSIVE AND ROTARY CRUSHING ROCK DRILLING PROVIDED WITH A DIAMOND LAYER

[75] Inventors: Mats G. Waldenström, Bromma; Udo K. R. Fischer, Vällingby; Lars H. Hillert, Saltsjö-Boo, all of Sweden; Mahlon D. Dennis, Kingwood, Tex.

[73] Assignee: Sandvik AB, Sandviken, Sweden

[ * ] Notice: The portion of the term of this patent subsequent to Jun. 8, 2010 has been disclaimed.

[21] Appl. No.: 715,636

[22] Filed: Jun. 14, 1991

[30] Foreign Application Priority Data

Jun. 15, 1990 [SE] Sweden ..... 9002135-3

[51] Int. Cl.[5] ..... E21B 10/46

[52] U.S. Cl. ..... 175/420.2; 175/426; 175/434

[58] Field of Search ..... 175/329, 410, 379, 415, 175/414

[56] References Cited

U.S. PATENT DOCUMENTS

| | | | |
|---|---|---|---|
| 2,941,248 | 6/1960 | Hall | 18/16.5 |
| 3,141,746 | 7/1964 | De Lai | 51/307 |
| 3,757,878 | 9/1973 | Wilder et al. | 175/329 |
| 3,757,879 | 9/1973 | Wilder et al. | 175/329 |
| 4,109,737 | 8/1978 | Bovenkerk | 175/329 |
| 4,148,368 | 4/1979 | Evans | 175/329 |
| 4,274,840 | 6/1981 | Housman | 175/329 X |
| 4,531,595 | 7/1985 | Housman | 175/329 |
| 4,592,433 | 6/1986 | Dennis | 175/329 |
| 4,593,776 | 6/1986 | Salesky | 175/375 |
| 4,694,918 | 9/1987 | Hall | 175/329 |
| 4,707,384 | 11/1987 | Schachner et al. | 427/249 |
| 4,718,505 | 1/1988 | Fuller | 175/329 |
| 4,731,296 | 3/1988 | Kikuchi et al. | 428/552 |
| 4,743,515 | 5/1988 | Fischer et al. | 428/698 |
| 4,751,972 | 6/1988 | Jones et al. | 175/329 |
| 4,764,434 | 8/1988 | Aronsson et al. | 428/565 |
| 4,766,040 | 8/1988 | Hillert et al. | 428/552 |
| 4,784,023 | 11/1988 | Dennis | 76/108 |
| 4,811,801 | 3/1989 | Salesky et al. | 175/329 |
| 4,819,516 | 4/1989 | Dennis | 76/101 |
| 4,820,482 | 4/1989 | Fischer et al. | 419/15 |
| 4,843,039 | 6/1989 | Akesson et al. | 501/87 |
| 4,858,707 | 8/1989 | Jones et al. | 175/329 |
| 4,871,377 | 10/1989 | Frushour | 51/309 |
| 4,889,017 | 12/1989 | Fuller et al. | 76/108 A |
| 4,972,637 | 11/1990 | Dyer | 51/295 |
| 5,007,207 | 4/1991 | Phaal | 51/204 |
| 5,074,623 | 12/1991 | Hedlund et al. | 175/409 X |

FOREIGN PATENT DOCUMENTS

| | | | |
|---|---|---|---|
| 272418 | 6/1988 | European Pat. Off. . | |
| 322214A1 | 6/1989 | European Pat. Off. . | |
| 2138864 | 10/1984 | United Kingdom | 175/329 |

*Primary Examiner*—Hoang C. Dang

*Attorney, Agent, or Firm*—Burns, Doane, Swecker & Mathis

[57] ABSTRACT

The present invention relates to a rock bit button of cemented carbide for percussive or rotary crushing rock drilling. The button is provided with a layer of diamond produced at high pressure and high temperature in the diamond stable area.

The cemented carbide has a multi-phase structure having a core that contains eta-phase surrounded by a surface zone of cemented carbide free of eta-phase.

8 Claims, 4 Drawing Sheets

TOOLS FOR PERCUSSIVE AND ROTARY CRUSHING ROCK DRILLING PROVIDED WITH A DIAMOND LAYER

FIELD OF THE INVENTION

The present invention concerns the field of rock bits and buttons therefor. More particularly, the invention relates to rock bit buttons for percussive and rotary crushing rock drilling. The buttons comprise cemented carbide provided with a diamond layer bonded by HP/HT (high pressure/high temperature) technique.

BACKGROUND OF THE INVENTION

There are three main groups of rock drilling methods: percussive, rotary crushing and cutting rock drilling. In percussive and rotary crushing rock drilling the bit buttons are working as rock crushing tools as opposed to cutting rock drilling, where the inserts work rather as cutting elements. A rock drill bit generally consists of a body of steel which is provided with a number of inserts comprising cemented carbide. Many different types of such rock bits exist having different shapes of the body of steel and of the inserts of cemented carbide as well as different numbers and grades of the inserts.

For percussive and rotary crushing rock drilling, the inserts often have a rounded shape, generally of a cylinder with a rounded top surface, generally referred to as a button.

For cutting rock drilling, the inserts often are provided with an edge acting as a cutter.

There already exists a number of different high pressure/high temperature (HP/HT) sintered cutters provided with polycrystalline diamond layers. These high wear resistant cutter tools are mainly used for oil drilling. The technique when producing such polycrystalline diamond tools using high pressure/high temperature has been described in a number of patents, e.g.:

U.S. Pat. No. 2,941,248: "High Temperature High Pressure Apparatus". U.S. Pat. No. 3,141,746: "Diamond Compact Abrasive". High pressure bonded body having more than 50% by volume diamond and a metal binder: Co, Ni, Ti, Cr, Mn, Ta, etc. These patents disclose the use of a pressure and a temperature where diamond is the stable phase.

In some later patents: e.g., U.S. Pat. Nos. 4,764,434 and 4,766,040, high pressure/high temperature sintered polycrystalline diamond tools are described. In the first patent, the diamond layer is bonded to a support body having a complex, non-plane geometry by means of a thin layer of a refractory material applied by PVD or CVD technique. In the second patent, temperature resistant abrasive polycrystalline diamond bodies are described having different additions of binder metals at different distances from the working surface.

A recent development in this field is the use of one or more continuous layers of polycrystalline diamond on the top surface of the cemented carbide button. U.S. Pat. No. 4,811,801 discloses rock bit buttons including such a polycrystalline diamond surface on top of the cemented carbide buttons having a Young's module of elasticity between 80 and $102\times106^6$ p.s.i., a coefficient of thermal expansion between 2.5 and $3.4\times10^{-6}$ °C$^{-1}$, a hardness between 88.1 and 91.1 HRA and a coercivity between 85 and 160 Oe. Another development is disclosed in U.S. Pat. No. 4,592,433, including a cutting blank for use on a drill bit comprising a substrate of a hard material having a cutting surface with strips of polycrystalline diamond dispersed in grooves, arranged in various patterns.

U.S. Pat. No. 4,784,023 discloses a cutting element comprising a stud and a composite bonded thereto. The composite comprises a substrate formed of cemented carbide and a diamond layer bonded to the substrate. The interface between the diamond layer and the substrate is defined by alternating ridges of diamond and cemented carbide which are mutually interlocked. The top surface of the diamond body is continuous and covering the whole insert. The sides of the diamond body are not in direct contact with any cemented carbide.

Another development in this field is the use of cemented carbide bodies having different structures in different distances from the surface. U.S. Pat. No. 4,743,515 discloses rock bit buttons of cemented carbide containing eta-phase surrounded by a surface zone of cemented carbide free of eta-phase and having a low content of cobalt in the surface and a higher content of cobalt closer to the eta-phase zone. U.S. Pat. No. 4,820,482 discloses rock bit buttons of cemented carbide having a content of binder phase in the surface that is lower and in the center higher than the nominal content. In the center there is a zone having a uniform content of binder phase. The tungsten carbide grain size is uniform throughout the body.

OBJECTS OF THE INVENTION

An object of the invention is to provide a rock bit button of cemented carbide with a diamond layer with high and uniform compression of the diamond layer by sintering at high pressure and high temperature in the diamond stable area. It is a further object of the invention to make it possible to maximize the effect of diamond on the resistance to cracking and chipping and to wear.

SUMMARY OF THE INVENTION

According to the present invention, there is provided a rock bit button for percussive and rotary crushing rock drilling comprising a body of cemented carbide at least partially covered with a diamond layer bonded at high pressure and high temperature, said button having a multi-phase structure with a core containing eta-phase surrounded by a surface zone free of eta-phase.

The button above can be adapted to different types of rocks by changing the material properties and geometries of the cemented carbide and/or the diamond, especially hardness, elasticity and thermal expansion, giving different wear resistance and impact strength of the button bits.

Percussive rock drilling tests using buttons of the type described in U.S. Pat. No. 4,811,801 with continuous polycrystalline layers on the surface of cemented carbide revealed a tendency of cracking and chipping off part of the diamond layer.

When using a cemented carbide body having a multi-structure according to U.S. Pat. No. 4,743,515 with a diamond layer (see FIG. 6 herein), it was surprisingly found that the cracking and chipping tendency of the diamond layer considerably decreased. The explanation for this effect, the increase of the resistance against cracking and chipping, might be a favorable stress pattern caused by the difference between the thermal expansion of the diamond layer and the cemented carbide body, giving the layer a high and uniform compressive prestress.

BRIEF DESCRIPTION OF THE DRAWINGS

The invention will be described with reference to the accompanying drawings in which 1=cemented carbide body
2=steel body
3=diamond layer or body
4=cemented carbide: Co-poor zone
5=cemented carbide: Co-rich zone
6=cemented carbide: eta-phase containing core

DETAILED DESCRIPTION OF THE PREFERRED EMBODIMENTS OF THE INVENTION

Figure 1:
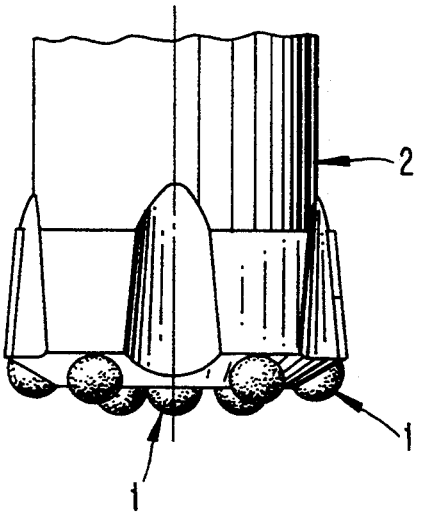
FIG. 1 shows a standard bit for percussive rock drilling provided with cemented carbide buttons.

The rock bit button according to the present invention comprises a cemented carbide body according to U.S. Pat. No. 4,743,515, the disclosure of which is herein incorporated by reference, and is provided with one or more polycrystalline diamond layers produced by HP/HT technique. The diamond layer can be of various shapes such as a completely or partly covered layer on top of the body of cemented carbide.

For special applications, the diamond on the convex carbide surface may be attached in rings or spirals. Independent of the shape, the surface length of the diamond layer shall be more than 1 mm (micrometer), preferably more than 2 mm and the thickness more than 0.2 mm, preferably 0.4–2.0 mm. The area of the layer of polycrystalline diamond should be more than 10%, preferably at least 50% of the top surface. The rock bit button shall have a diameter of 5–50 mm, preferably 7–35 mm. For shapes other than cylindrical, the rock bit inserts for percussive and rotary crushing are also possible such as chisel-shaped, spherical, oval or conical. Other more asymmetric shapes could also be used such as rectangular, pyramids or square pyramids.

The polycrystalline diamond layer shall be adapted to the type of rock and percussive or rotary crushing method by varying the grain size of the diamond and the amount of catalyst metal. The grain size of the diamond shall be 3–300 mm, preferably 35–150 mm. The diamond may be of only one nominal grain size or consist of a mixture of sizes, such as 80 w/o of 40 mm and 20 w/o of 10 mm. Different types of catalyst metals can be used such as Co, Ni, Mo, Ti, Zr, W, Si, Ta, Fe, Cr, Al, Mg, Cu, etc., or alloys between them. See U.S. Pat. No. 4,766,040, the disclosure of which is herein incorporated by reference. The amount of catalyst metal shall be 1–40% by volume, preferably 3–20% by volume.

In addition other hard materials, preferably less than 50% by volume, can be added such as cBN, $B_4C$, $TiB_2$, SiC, ZrC, WC, TiN, ZrB, ZrN, TiC, (Ta,Nb)C, Cr-carbides, AlN, $Si_3N_4$, $AlB_2$, etc., as well as whiskers of $B_4C$, SiC, TiN, $Si_3N_4$, etc. (See U.S. Pat. No. 4,766,040).

The layer of polycrystalline diamond may have different levels of catalyst metal at different distances from the working surface according to U.S. Pat. No. 4,766,040.

The cemented carbide grade shall be chosen with respect to type of rock and percussive and rotary crushing methods. It is important to choose a grade which has a suitable wear resistance compared to that of the polycrystalline diamond body. The nominal binder phase content shall be 3–35% by weight, preferably 5–12% by weight for percussive and preferably 5–25% by for rotary crushing rock drilling buttons and the grain size of the cemented carbide at least 1 mm, preferably 2–6 mm. The cemented carbide body shall have a core containing eta-phase. The size of this core shall be 10–95%, preferably 30–65% of the total amount of cemented carbide in the body. The core should contain at least 2% by volume, preferably at least 10% by volume of eta-phase but at most 60% by volume, preferably at most 35% by volume.

In the zone free of eta-phase, the content of binder phase (i.e., in general the content of cobalt), shall in the surface be 0.1–0.9, preferably 0.2–0.7, the nominal content of binder phase and the binder phase content shall increase in the direction towards the core up to a maximum of at least 1.2, preferably 1.4–2.5, the nominal content of binder phase. The width of the zone poor in binder phase shall be 0.2–0.8, preferably 0.3–0.7, of the width of the zone free of eta-phase but at least 0.4 mm and preferably at least 0.8 mm in width.

The bodies of polycrystalline diamond may extend a shorter or longer distance into the cemented carbide body. In one embodiment, the polycrystalline diamond layer consists of a prefabricated and sintered layer in which the catalyst metal has been extracted by acids. The layer is attached by the HP/HT technique. This method gives a favorable stress distribution and a better thermal stability because of the absence of the catalyst metal.

In another embodiment, the cemented carbide substrate has been provided with diamond bodies of different shapes according to our copending U.S. patent application Ser. No. 07/511,096, now U.S. Pat. No. 5,154,245, the disclosure of which is hereby incorporated by reference, beneath a top layer of diamond.

The cemented carbide buttons are manufactured by powder metallurgical methods according to U.S. Pat. No. 4,743,515. After sintering of the cemented carbide the mixture of diamond powder, catalyst metal and other ingredients is put on the surface of the cemented carbide body, enclosed in thin foils and sintered at high pressure, more than 3.5 GPa, preferably at 6–7 GPa, and at a temperature of more than 1100° C., preferably 1700° C. for 1–30 minutes, preferably about 3 minutes.

The content of catalyst metal in the diamond layer may be controlled either by coating the button before applying the diamond layer with a thin layer of, e.g., TiN by CVD- or PVD-methods or by using thin foils such as Mo as disclosed in U.S. Pat. No. 4,764,434. After high-pressure sintering the button is blasted and ground to final shape and dimension.

The description above concerns diamond and the HP/HT technique of bonding but the same principles are also valid for cBN.

The invention is additionally illustrated in connection with the following Examples which are to be considered as illustrative of the present invention. It should be understood, however, that the invention is not limited to the specific details of the Examples.

EXAMPLE 1

Percussive Rock Drilling

In a test in a quartzite quarry, the penetration rate and the life length of the bits with buttons having a multi-phase structure of the cemented carbide and a layer of polycrystalline diamond according to the invention were compared to bits with buttons of conventional cemented carbide, with buttons having a multi-phase structure and with bits with a layer of polycrystalline diamond and having a conventional structure of the cemented carbide. All buttons in a bit had the same composition.

The drill bit having 6 buttons on the periphery was a bit with a special and strong construction for use in very hard rocks (FIG. 1).

Figure 3:
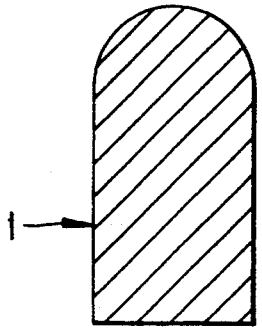
FIG. 3 shows a standard cemented carbide button without diamond.

Bit A. (FIG. 3) All buttons on the periphery consisted of cemented carbide with 6% by weight cobalt and 94 % by weight WC having a grain size of 2 mm. The hardness of 1450 HV3.

Figure 4:
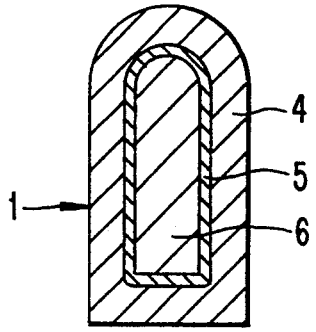
FIG. 4 shows a button where the cemented carbide contains eta-phase surrounded by a surface zone of cemented carbide free of eta-phase.

Bit B. (FIG. 4) All buttons on the periphery consisted of cemented carbide having a core that contained eta-phase surrounded by a surface zone of cemented carbide free of eta-phase having a low content of cobalt (3% by weight) at the surface and said Co-content increasing towards the eta-phase core to a maximum of 11%.

Figure 5:
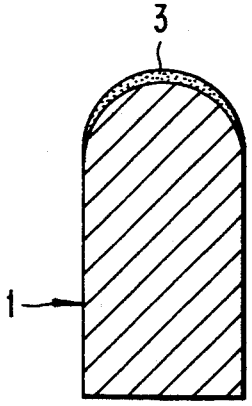
FIG. 5 shows a button of cemented carbide with a top layer of diamond.

Bit C (FIG. 5) All buttons on the periphery consisted of cemented carbide having a continuous 0.7 mm thick top layer of polycrystalline diamond.

Figure 6:
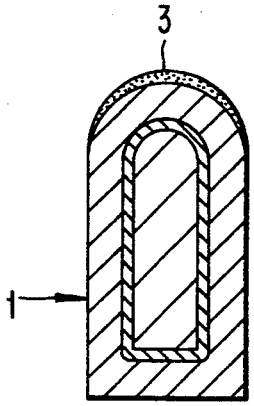
FIG. 6 shows a button of cemented carbide with a top layer of diamond where the cemented carbide contains eta-phase surrounded by a surface zone of cemented carbide free of eta-phase.
Figure 7A:
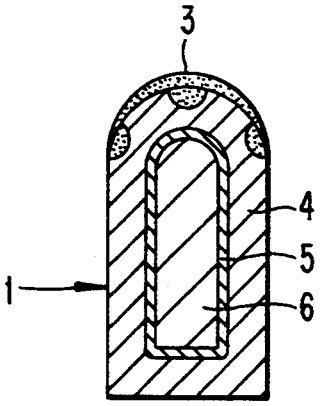
FIGS. 7A, 7B, 8A, 8B, 9A, 9B, 10A, 10B, 11A, 11B, 12A, 12B, 13A, 13B, 14A and 14B, show buttons of cemented carbide with a top layer of diamond and different types of diamond bodies beneath the top layer and inside the body of cemented carbide. In each instance, the core of the cemented carbide body contains eta-phase surrounded by a surface zone of cemented carbide free of eta-phase.
Figure 8A:
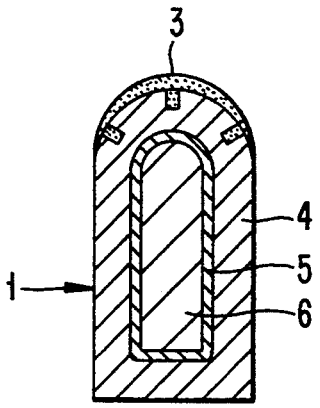
Figure 7B:
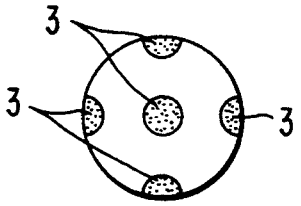
Figure 8B:
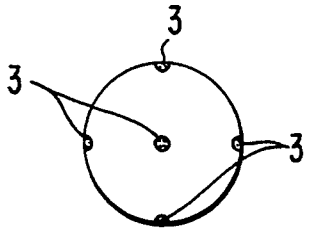
Figure 9A:
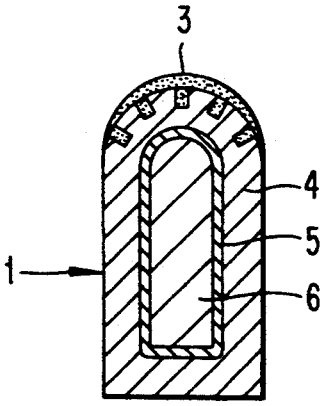
Figure 10A:
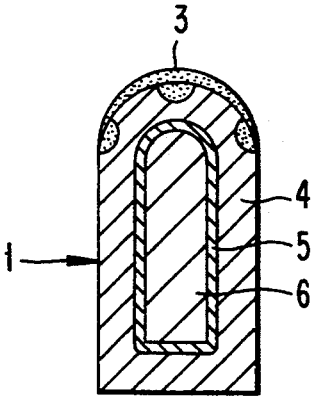
Figure 9B:
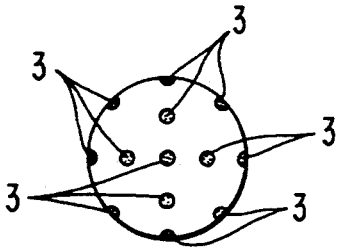
Figure 10B:
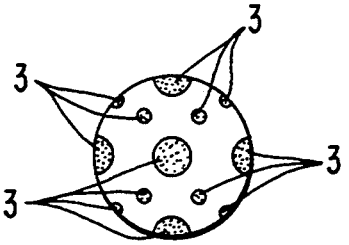
Figure 11A:
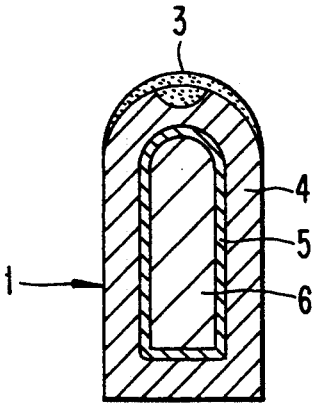
Figure 12A:
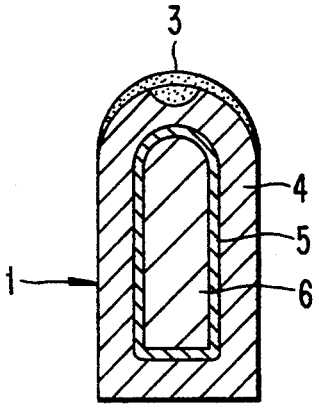
Figure 11B:
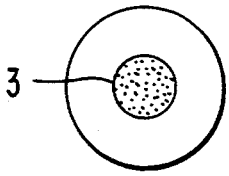
Figure 12B:
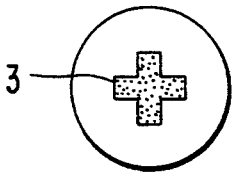
Figure 13A:
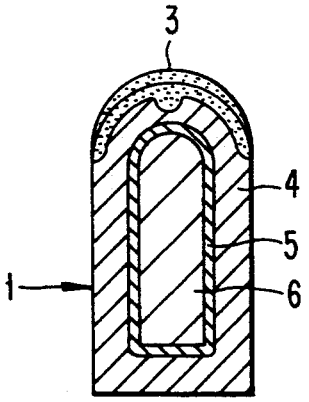
Figure 14A:
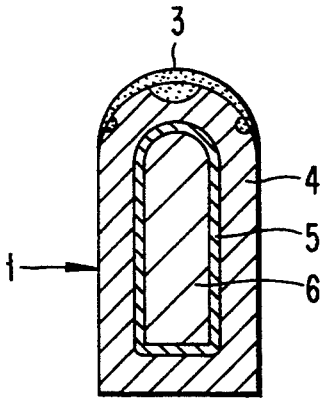
Figure 13B:
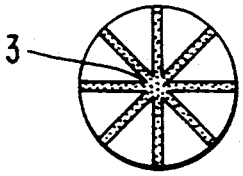
Figure 14B:
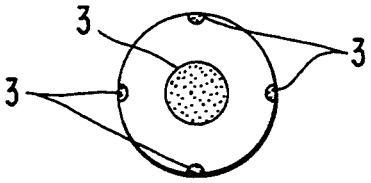

Bit D (FIG. 6) All buttons on the periphery consisted of cemented carbide having a multi-phase structure and a continuous 0.7 man thick layer of polycrystalline diamond on top of the body of cemented carbide.

The buttons of cemented carbide had a core that contained eta-phase surrounded by a surface zone of cemented carbide free of eta-phase having a low content of cobalt (3% by weight) at the surface and said Co-content increasing towards the eta-phase core to a maximum of 11%.

The test data were:

Application: Bench drilling in very abrasive quartzite
Rock drilling: COP 1036
Drilling rig: REC 712
Impact pressure: 190 bar
Stoke position: 3
Feed pressure: 70–80 bar
Rotation pressure: 60 bar
Rotation: 120 r.p.m.
Air pressure: 4.5 bar
Hole depth: 6–18 m

RESULTS

| Type of Button | No. of Bits | Average Life m | Average Penetration m per minute |
|---|---|---|---|
| A (FIG. 3) | 6 | 111 | 1.1 |
| B (FIG. 4) | 6 | 180 | 1.2 |
| C (FIG. 5) | 6 | 280 | 1.3 |
| D (FIG. 6) | 6 | 350 | 1.4 |

EXAMPLE 2

Rotary Crushing Rock Drilling

Figure 2:
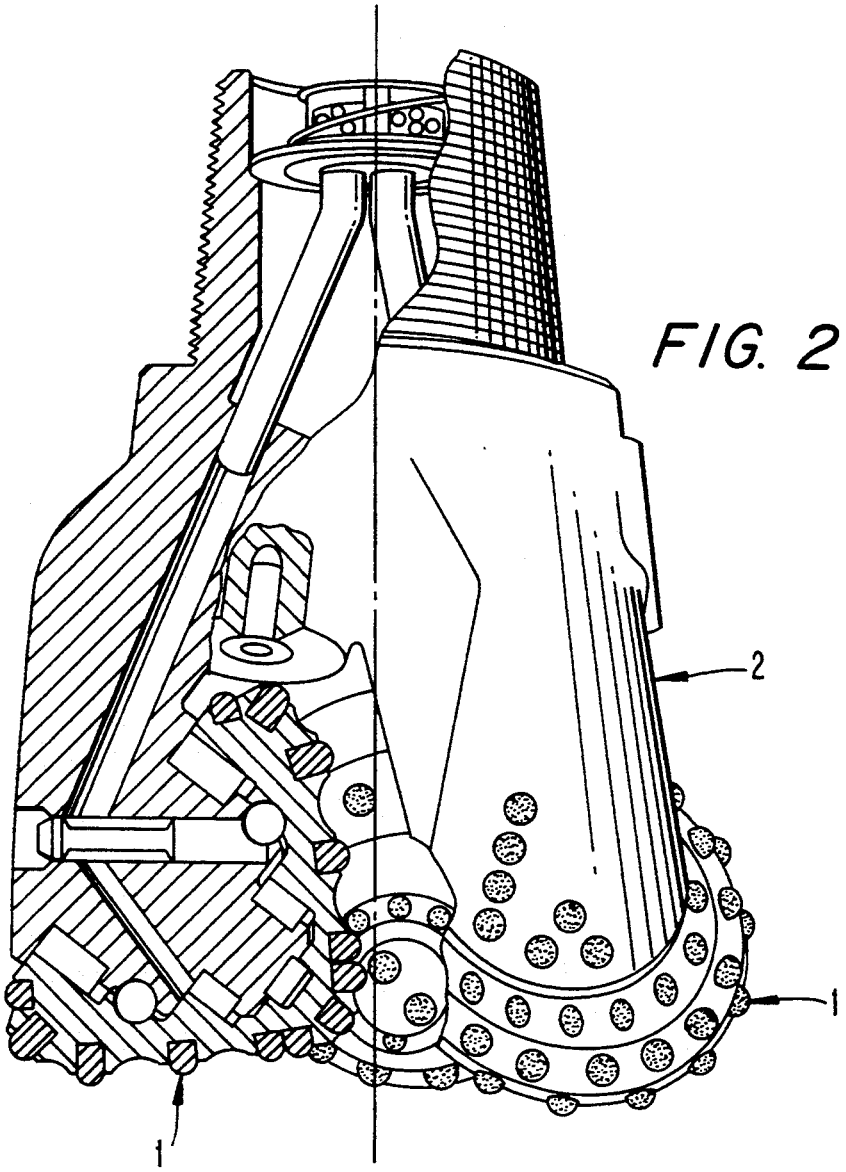
FIG. 2 shows a standard bit for rotary crushing rock drilling provided with cemented carbide buttons.

In an open-cut iron ore mine buttons according to the invention were tested in roller bits. The roller bits were of the type 12¼" CH with totally 261 spherical buttons. The diameter of the buttons was 14 mm on row 1–3 and 12 mm on row 4–6 (FIG. 2).

The same type of buttons: A, B, C and D were used in EXAMPLE 2 as in EXAMPLE 1, except that the cemented carbide had 10 w/o cobalt and 90 w/o WC and a hardness of 1200 HV3. The test buttons, 77 pieces, were placed in row 1. The remaining buttons were of the standard type.

The performance in form of lifetime and penetration rate was measured. The drilling data were the following:

Drill rig: 4 pcs BE 60 R
Feed pressure: 60,000–80,000 lbs
RPM: 60
Bench Height: 15 m
Hole depth: 17 m
Rock formation: Iron Ore: very hard rock

RESULTS

| Type of Button | No. of Bits | Average Life m | Average penetration m per hour |
|---|---|---|---|
| A (FIG. 3) | 1 | 1400 | 15 |
| B (FIG. 4) | 1 | 1700 | 16 |
| C (FIG. 5) | 1 | 1900 | 17 |
| D (FIG. 6) | 1 | 2200 | 20 |

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A rock bit button for percussive and rotary crushing rock drilling comprising a body of cemented carbide at least partly covered with a diamond layer bonded at high pressure and high temperature, said button having a multi-phase structure with a core containing eta-phase surrounded by a surface zone free of eta-phase.

2. A rock bit button according to claim 1, wherein the binder phase content in a zone close to the eta-phase containing core is higher than the nominal binder phase content.

3. A rock bit button according to claim 1, wherein the binder phase content in the surface of said button is 0.1–0.9 of the nominal binder phase content.

4. A rock bit button according to claim 1, wherein said button contains at least one diamond body at least partly within the cemented carbide rock bit button beneath the said diamond layer.

5. A rock bit button according to claim 4, wherein said diamond body is prefabricated and bonded to said rock bit button at high pressure and high temperature.

6. A rock bit button according to claim 5, wherein said diamond body is prefabricated using a catalyst metal, which catalyst metal is removed prior to bonding of said body to said button.

7. A rock bit button according to claim 4, wherein the diamond in the said diamond body and the said diamond layer is compressively prestressed.

8. A rock bit button according to claim 1, wherein said diamond layer completely covers the top of said button.

* * * * *